US006009646A

United States Patent [19]

Johnson

[11] Patent Number: 6,009,646

[45] Date of Patent: Jan. 4, 2000

[54] APPARATUS FOR TYING AND BINDING BALES OF COMPRESSED MATERIALS

[75] Inventor: Gerald L. Johnson, Carthage, Mo.

[73] Assignee: L&P Property Management Company, Southgate, Calif.

[21] Appl. No.: 09/092,664

[22] Filed: Jun. 5, 1998

[51] Int. Cl.[7] ..... B21F 9/02

[52] U.S. Cl. ..... 40/93.6; 140/93.2; 140/116; 140/118; 140/149; 100/29; 100/31

[58] Field of Search ..... 140/93.6, 115, 140/120, 93 R, 93.2, 116, 118, 149; 100/31, 29, 32, 34; 269/238, 254 CS, 231, 217, 152

[56] References Cited

U.S. PATENT DOCUMENTS

| | | | |
|---|---|---|---|
| 218,741 | 8/1879 | Higgins . | |
| 399,856 | 3/1889 | Eisenhart . | |
| 664,326 | 12/1900 | Kintzing . | |
| 743,520 | 11/1903 | Kennedy . | |
| 875,654 | 12/1907 | Christensen . | |
| 985,023 | 2/1911 | Fry . | |
| 989,260 | 4/1911 | Hinckley . | |
| 1,180,934 | 4/1916 | Mottier . | |
| 1,507,376 | 9/1924 | Hintz . | |
| 1,581,794 | 4/1926 | DeHaven, Jr. . | |
| 1,699,482 | 1/1929 | Stevens . | |
| 1,706,116 | 3/1929 | Harrah . | |
| 1,889,372 | 11/1932 | Nolan . | |
| 1,939,746 | 12/1933 | Whitman | 140/93.6 |
| 2,098,945 | 11/1937 | Davis | 140/115 |
| 2,173,403 | 9/1939 | Trimble . | |
| 2,277,394 | 3/1942 | Everhart et al. | 140/115 |
| 2,757,599 | 8/1956 | Nolt et al. . | |
| 2,777,384 | 1/1957 | Nolt et al. . | |
| 2,792,776 | 5/1957 | Tarbox . | |
| 2,796,662 | 6/1957 | Saum . | |
| 2,812,707 | 11/1957 | Cheesman | 100/31 |
| 2,859,687 | 11/1958 | Hill . | |
| 2,868,239 | 1/1959 | Ellis . | |
| 2,907,356 | 10/1959 | Mille | 140/93.6 |
| 2,922,359 | 1/1960 | Brouse et al. . | |
| 2,982,199 | 5/1961 | Jones . | |
| 3,149,559 | 9/1964 | Lynch . | |
| 3,157,109 | 11/1964 | Flanigan et al. | 100/26 |
| 3,541,828 | 11/1970 | Norman . | |
| 3,794,086 | 2/1974 | Hall et al. | 140/93.2 |
| 3,918,358 | 11/1975 | Burford | 100/19 |
| 4,120,238 | 10/1978 | Schafer et al. | 100/11 |
| 4,155,296 | 5/1979 | Schafer | 100/3 |
| 4,164,176 | 8/1979 | Brouse et al. | 100/4 |
| 4,167,902 | 9/1979 | Bister et al. | 100/3 |
| 4,178,845 | 12/1979 | DeGryse | 100/11 |
| 4,228,733 | 10/1980 | Davis et al. | 100/4 |
| 4,459,904 | 7/1984 | Probst et al. | 100/11 |
| 4,572,554 | 2/1986 | Janssen et al. | 289/17 |
| 4,577,554 | 3/1986 | Brouse | 100/26 |
| 4,817,519 | 4/1989 | Brouse et al. | 100/32 |
| 4,830,065 | 5/1989 | Fenley | 140/118 |
| 5,279,336 | 1/1994 | Kusakari et al. | 140/57 |
| 5,433,255 | 7/1995 | Wiedel | 140/115 |
| 5,467,804 | 11/1995 | Kupferschmidt et al. | 140/93.6 |

FOREIGN PATENT DOCUMENTS

| | | |
|---|---|---|
| 152933 | 8/1953 | Australia . |

OTHER PUBLICATIONS

United States Steel, *Round Steel Strapping Machines—Manually Operated,* Sales Material, undated 2 pages.

*Primary Examiner*—Ed Tolan
*Attorney, Agent, or Firm*—Wood, Herron & Evans, LLP

[57] ABSTRACT

An apparatus for tying a bale of material with a baling wire comprises an elongated body having a longitudinal axis and opposite ends, and a leg extending from each end of the body and including a forked portion. A retention clip is rotationally mounted about an axis proximate each of the forked portions, and the axis of rotation of each clip is oriented generally parallel to the longitudinal axis of the body. The clips are operable to rotate automatically in a first direction on said axes when wires, oriented along the longitudinal axis of the body, are directed against the clips, and are further operable to automatically rotate in a second direction to capture wires directed thereagainst for maintaining wires along the body between the clips.

10 Claims, 4 Drawing Sheets

APPARATUS FOR TYING AND BINDING BALES OF COMPRESSED MATERIALS

FIELD OF THE INVENTION

The present invention relates to the tying or binding of bales of compressed material, and more specifically, the invention relates to an apparatus for maintaining overlapped ends of baling wires together to assist in the tying and securing of the wires around bales.

BACKGROUND OF THE INVENTION

Various types of loose materials are shipped, stored, and otherwise processed and distributed in the form of compressed bales. For example, cotton and recycled paper are processed into compressed bales so that a greater amount of such materials may be stored and shipped in a smaller space. Also, bales are generally easier and more efficient to handle than the loose, bulk material.

When the loose material is compressed into bales, it is generally known to wrap and tie such bales with wire or other elongated binding devices to keep the bales in a compressed form, such as for shipping and storage. Wire is often most preferable as a binding device because of its low cost and the ease with which it is handled. One method of forming a bale directs the compressible material into an automatic baler where it is pressed into a bale by a ram and then moved on a path by the ram through the baler. Continuous wire strands extend across the bale path at different heights on the bale and, as the bale moves through the baler, the wire strands are wrapped around the front end and sides of the bale. For such automatic balers, automatic tying systems are often used to engage the bale and wire strands and tie the wire strands around the bale, such as by twisting together the overlapped ends of the wire strands. Examples of various automatic tying methods are illustrated in U.S. Pat. Nos. 4,120,238; 4,155,296; 4,167,902, and 4,459,904.

While automatic tying methods and apparatuses have proven suitable for baling and tying compressed bales in certain applications, they generally require complex, expensive machinery which has to manipulate the wires and bales together to form and tie the bale. Certain applications require hand splicing or tying of the wires wrapped around a bale in order to reduce the complexities and costs associated with automatic tying mechanisms. Furthermore, the particular material being baled may dictate that hand tying is required, because of the complexities involved in trying to design an automatic tying apparatus.

Hand tying or splicing mechanisms in the prior art have provided a means for splicing or tying two wires together. However, many such devices require that the wires be carefully positioned in the twisting gears or pinions of the mechanisms for proper operation. As will be appreciated, when a baling wire is wrapped around a bale of compressed material, the ends of the wire will have a tendency to extend or jut into various different directions. This is particularly so since the wires are generally under tension from the compressed material. The overlapped wire ends will rarely, if ever, lay side by side to be easily twisted and tied together. Therefore, hand tying a bale has been a two-person operation where one person holds the wire ends together in an overlapped fashion while another person actually twists and ties the overlapped wires. Even if a single person were to attempt the operation, it is very difficult to maintain the wire ends in an overlapped relationship while the ends are twisted together.

To further exacerbate the problem, each bale of material will generally require several wraps and ties of the baling wire or other binding device.

It is therefore an objective of the present invention to provide a simple and inexpensive apparatus to assist in tying a wire around a bale rapidly and easily.

It is another objective of the invention to maintain overlapped ends of baling wire together during tying for a proper knot.

It is a further objective of the present invention to simplify the tying process when wrapping a bale of material.

These and other objectives will become more readily apparent from the Summary of the Invention and Detailed Description set forth hereinbelow.

SUMMARY OF THE INVENTION

The present invention comprises an apparatus to assist in the tying of a bale of compressed material with a baling wire and specifically is usable with a hand or manual tying device. The apparatus comprises an elongated body having a longitudinal axis and opposite ends. Legs extend from each end of the body generally at a right angle to the body. The legs each include a forked portion to which a retention clip is mounted to receive the overlapped ends of the wires wrapped around the bales. The apparatus is mounted or positioned proximate a bale of material and the overlapped ends of the baling wire are placed against the retention clips. The retention clips are rotationally mounted about a pin extending through the forked portions and defining an axis proximate each of the forked portions.

The axis of rotation of each clip is oriented generally parallel to the longitudinal axis of the body, and the clips are operable to automatically rotate in a first direction on the defined axes automatically when wires, oriented along the longitudinal axis of the body, are directed against the clips. That is, simply directing the wires against the clips is sufficient for securing the overlapped wire ends in the standoff apparatus without any additional steps. The clips are further operable to automatically rotate in a second direction to capture the overlapped wire ends directed thereagainst for maintaining wires along the body between the clips. The retention clips are biased by biasing springs coupled between the clips and the body which are operable for biasing each of the retention clips in the second direction against the body for automatically capturing wires against the body. In one embodiment of the invention, the biasing springs are stretched under tension between the retention clips and the body. In another embodiment of the invention the springs are compressed between the retention clips and the body.

To guide the wires into position under the clips, an embodiment of the inventive apparatus has clips which include sloped surfaces configured to slope toward the body, the sloped surfaces causing the clips to move in the first direction automatically when the wires are oriented along the longitudinal axis and are directed against the sloped surfaces of the clips. Alternatively, the forked portions of the legs comprise sloped surfaces configured to slope toward the retention clips. The sloped surfaces cause the clips to move in the first direction when wires oriented along the longitudinal axis are directed against the sloped surfaces of the body.

To provide tension of one of the overlapped wire ends captured in the standoff mechanism, a cam is rotationally mounted with respect to at least one of the clips and is oriented along the longitudinal axis of the body. The cam is configured for engaging wires captured by the clip and is rotatable in one direction to allow a wire to pass thereby as the wire is moved along the body in that direction. The cam is generally not rotatable in the other direction and thereby grips the tensioned wire which wants to move in the opposite direction.

To align the standoff apparatus with a hand tying device, the apparatus further comprises comprising a projection which extends from the body and is configured to engage a opening in a hand tyer to align the hand tyer with the body. In that way, the twist of the wires made by the hand tyer us usually at the center of the overlapped wire ends as desired.

BRIEF DESCRIPTION OF THE FIGURES

The accompanying drawings, which are incorporated in and constitute a part of this specification, illustrate embodiments of the invention and, together with a general description of the invention given below, serve to explain the principles of the invention.

DETAILED DESCRIPTION

Figure 1:
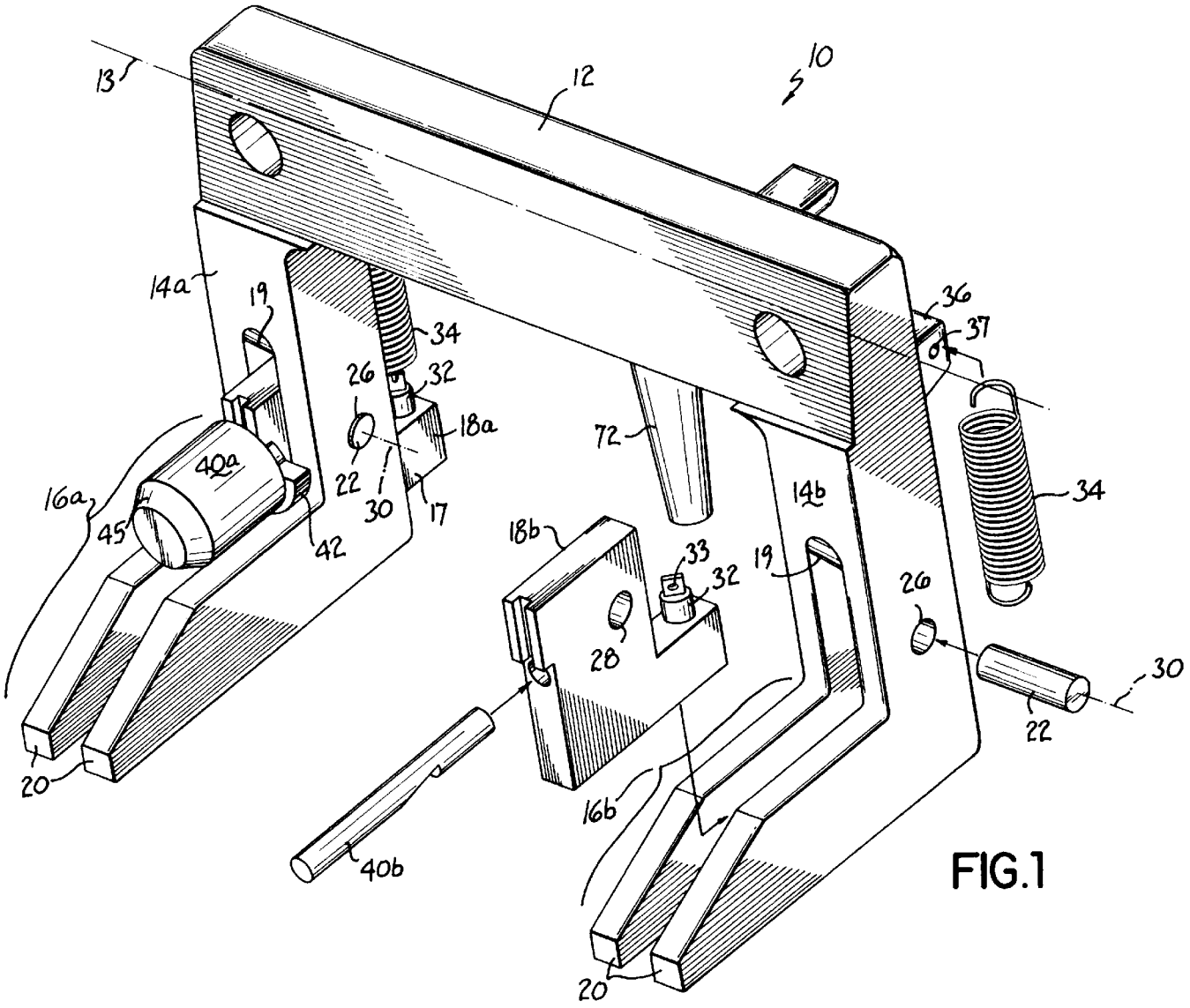
FIG. 1 is a perspective, disassembled view of one embodiment of the present invention.

FIG. 1 illustrates a perspective disassembled view of one embodiment of the present invention. The standoff apparatus 10 includes an elongated body 12 having a longitudinal axis 13. At opposite ends, legs 14*a*, 14*b* extend from each end of the body 12 at generally right angles to the longitudinal axis. Each of the legs 14*a*, 14*b* includes a forked portion 16*a*, 16*b*, respectively. Part of the forked portions extends generally at right angles to the rest of the legs. The legs 14*a*, 14*b* of the embodiment illustrated in FIG. 1, therefore extend from the body 12 generally perpendicular to longitudinal axis 13 of the body and also form a 90° angle as illustrated in FIG. 1. To use the standoff apparatus 10 of the invention, the body 12 is generally mounted or otherwise positioned horizontally or vertically next to a bale of material to receive overlapped wire ends of wires wrapped around the bale.

Retention clips 18*a*, 18*b* are mounted proximate each of the respective forked portions 16*a*, 16*b*. As illustrated in FIG. 1, the retention clips are mounted between the prongs 20 of the respective forked portion 16*a*, 16*b* and rotate about a pin 22 extending into appropriately formed apertures 26, 28 in the forked portions 16*a*, 16*b*, and retention clips 18*a*, 18*b*, respectively. The pins 22 form axes of rotation 30 which are generally parallel to the longitudinal axis 13 of the body 12.

The clips are operable to rotate about the pins 22 and axes 30 to capture and hold wires inserted into the standoff apparatus 10, as discussed further hereinbelow. To that end, the clips 18*a*, 18*b* are operable to automatically rotate in one direction about the axis 30 when baling wire to be tied is directed against the clips, and are further operable to automatically rotate in a second, or opposite, direction about the axis 30 to capture wires that are directed thereagainst from maintaining those wires along the body between the ends of the body and the retention clips 18*a*, 18*b* (see FIGS. 2A, 2B).

Referring to FIG. 1, each retention clip is generally L-shaped and includes a mount 32 for receiving an end of a biasing spring 34. An opposing mount 36 is fixed to body 12 spaced from the forked portion and receives another end of the bias spring 34. As illustrated in FIG. 1, the respective bases 17 of each of the L-shaped retention clips 18*a*, 18*b* face rearwardly into the forked portions 16*a*, 16*b* and thus position the mount 32 behind the various pins 22 and axes 30. The mount 36 also extends rearwardly of the pins 22 and axes 30. The ends of the biasing spring 34 are hook-shaped and extend through the appropriately formed apertures 33, 37 in the mounts 32, 36, respectively. The springs 34 bias the clips 18*a*, 18*b* into a position against the forked portion 16*a*, 16*b* of the legs 14*a*, 14*b* so that the clips 18*a*, 18*b* will capture wires positioned against the standoff apparatus 10. As illustrated, the biasing springs 34 are stretched to extend between the mounts 32, 36 and are operable to pull the mounts 32 in the base of the L-shaped retention clips against the stationary mount 36. The forked portions 16*a*, 16*b* each include a stop surface 19 formed to engage a surface of the clips 18*a*, 18*b* and prevent over-rotation (see FIGS. 2, 2A and 2B) Each of the retention clips includes an appropriate arm 40*a*, 40*b* which extends therefrom to assist in capturing the wires against the clips 18*a*, 18*b*. In the embodiment illustrated in FIG. 1, one of the retention clips 18*a*, includes a cam 42 rotationally mounted with respect to the clip 18*a*. As discussed further hereinbelow, the cam 42 is oriented along the longitudinal axis 13 of the body and is configured for engaging wires captured by the clip 18*a*. The cam 42 is rotatable in one direction and allows the wire to pass thereby as the wire is moved and tensioned along the body 12 in that direction. The cam generally does not rotate in the other direction to thereby grip the tensioned wire when it seeks to move in that opposite direction. That is, the cam rotates generally in one direction and then back to a rest position so that tension may be placed on wires captured by the standoff apparatus 10 as discussed further hereinbelow.

Figure 2A:
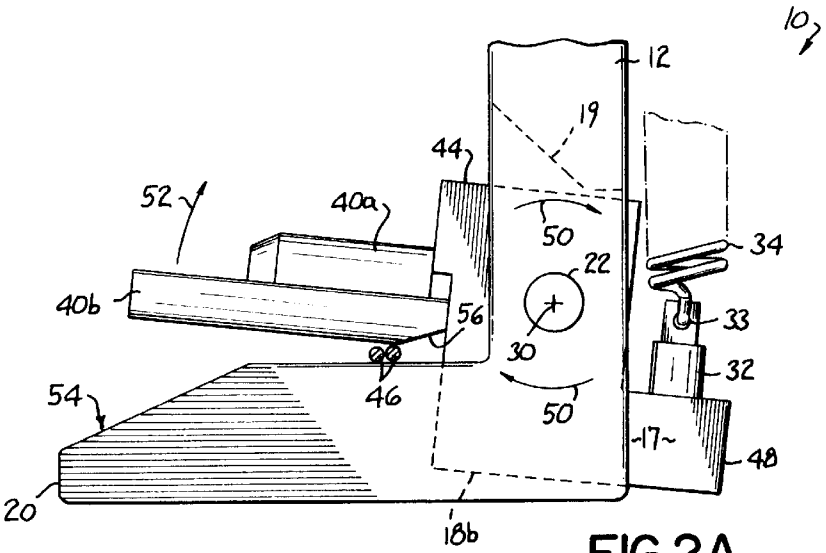
FIGS. 2A and 2B are side views similar to FIG. 2 illustrating the retention clips in a raised position and a lowered position, respectively, to capture overlapped wire ends.
Figure 2B:
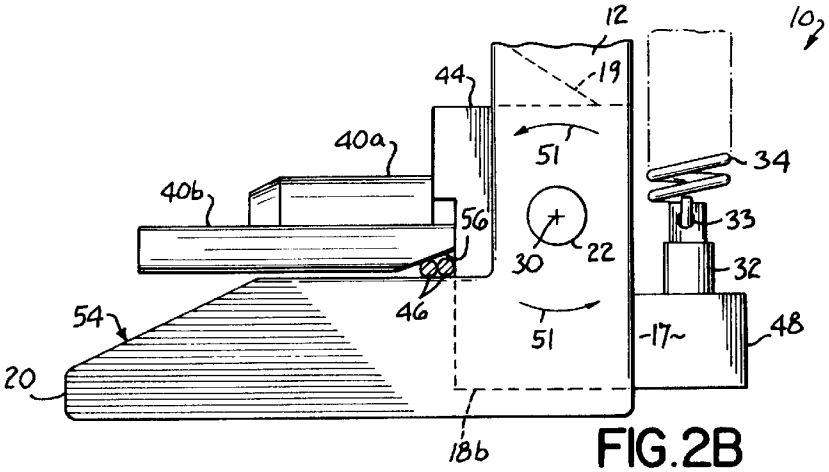
Figure 2:
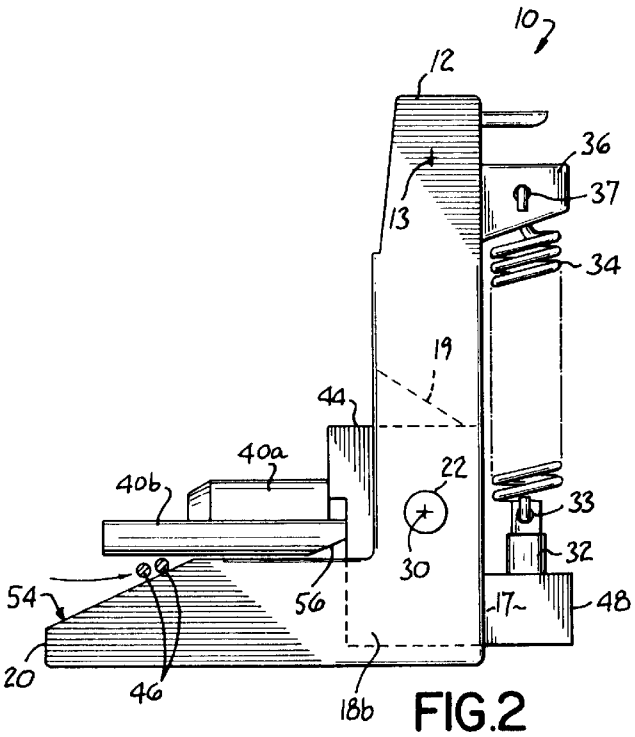
FIG. 2 is a side view of the embodiment of FIG. 1.

Referring to FIG. 2, a side view of the standoff apparatus 10 is illustrated. FIGS. 2A and 2B illustrate a retention clip engaging and holding overlapped wire ends 46 in the captured position. Referring again to FIG. 2, body 12 is shown from the side thereof wherein clip 18*b* pivots about pin 22 and axis 30. Each clip 18*a*, 18*b* includes a forward portion 44 with arms 40*a*, 40*b* which generally capture the wire overlapped ends 46 and a biased portion 48 which is generally biased by the biasing spring 34 to thereby direct the capture portion 44 to capture the wires 46. As noted, capture portion 44 of each clip 18*a*, 18*b* will generally include the arms 40*a*, 40*b* of the retention clips. Bias portion 48 which includes part of the base 17 of the L-shaped retention clip secures mount 32. Mount 36 is rigidly fixed to the body 12. The biasing spring 34 is stretched under tension between the mounts 32, 36 and thus is stretched under tension between body 12 and the retention clips 18*a*, 18*b*. That is, when the bias spring 34 is hooked into the apertures 33, 37 of the respective mounts, it will be stretched as illustrated in FIG. 2 to provide a biasing force on the respective clips.

FIGS. 2A and 2B illustrate operation of the clips for capturing the wires against the standoff apparatus 10. Referring to FIG. 2, when wire ends 46, oriented generally along the longitudinal axis 13 of body 12, are directed against the clips 18*a*, 18*b* the clips are operable to automatically rotate in a first direction 50 wherein each of the clips, and specifically the respective arms 40*a*, 40*b* are moved in the direction of arrow 52 away from the respective forked portions 16*a*, 16*b* of the legs. In that way, the wires 46 slide between the clips and the forked portions 16*a*, 16*b* of the legs 14*a*, 14*b*. The forked portions 16*a*, 16*b*, and specifically the prongs 20 of the forked portions, include sloped surfaces 54 which act to direct the wires 46 against the respective arms 40*a*, 40*b* of the clips so that the clips automatically rotate in the first direction 50 to capture the wires 46, which are forced against the standoff apparatus. Arm 40*b* includes a notched section 56 for receiving the overlapped wire ends 46. As shown in FIG. 2B, the wires 46 are captured by the notch 56 and the retention clip 18*b* rotates in a second direction 51 to capture the wires 46. At the other end of body 12, the wires are captured under the cam 42.

Figure 3:
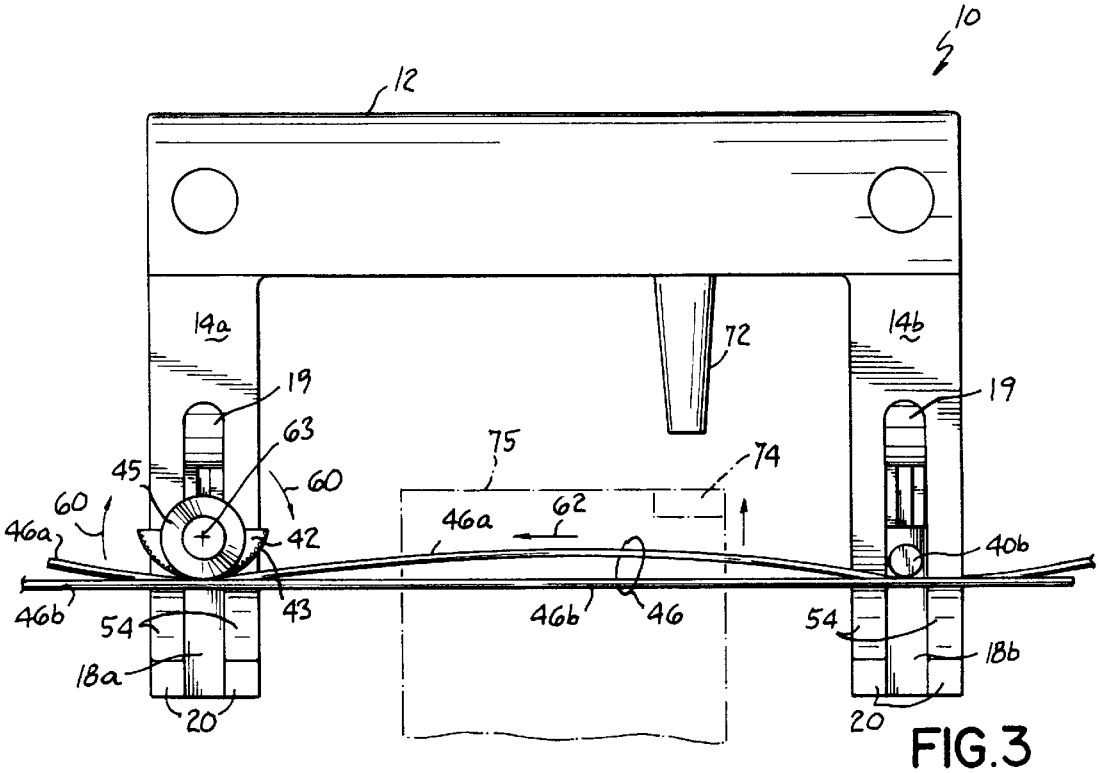
FIG. 3 is a top view of the embodiment of FIG. 1.
Figure 3A:
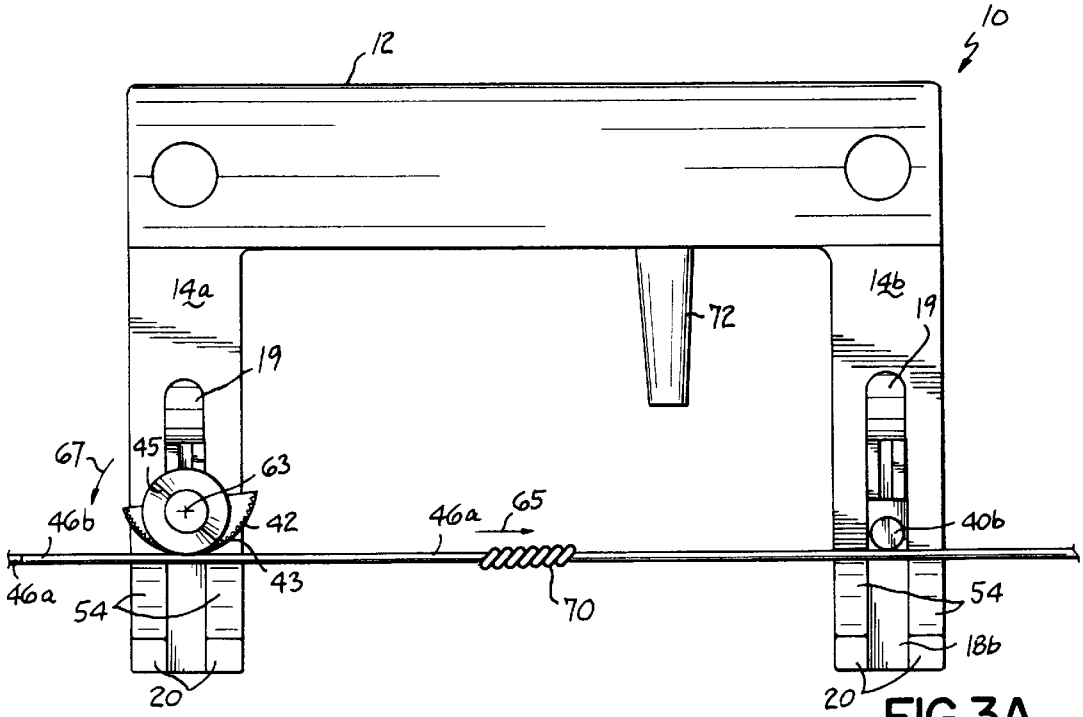
FIG. 3A is another top view of the embodiment of FIG. 1 showing the overlapped wire ends twisted together.

Referring to FIGS. 3 and 3A, the cam 42 includes a serrated edge 43 which grips the section of the wire ends 46 positioned thereunder. Arm 40*a* also includes a sloped surface 45 to assist in sliding the wires 46 thereunder and beneath the serrated edge 43 of the cam 42. As shown in FIG. 3, when the overlapped wire ends 46 are captured by the retention clips 18*a*, 18*b* the overlapped wire ends are stretched between the legs 14*a*, 14*b* of apparatus 10 and along body 12 generally parallel to axis 13. The wire ends 46 are thereby held in position.

Referring to FIG. 3, cam 42 operates by rotating in one direction, but generally not in the other direction. For example, cam 42 will generally not rotate in the clockwise direction, as illustrated by arrows 60, but will rotate in a counterclockwise direction. In that way, one of the individual wire ends 46*a* of the overlapped ends may be pulled to create tension on the baling wire 46. Specifically, as illustrated in FIG. 3, when the overlapped wire ends 46*a*, 46*b* are positioned together and inserted into the standoff apparatus 10 to be held by the retention clips, the wire ends may be loose. In accordance with one aspect of the present invention, one of the wire ends, such as wire end 46*a*, may be gripped and pulled in the direction illustrated by arrow 62. When that occurs, the cam 42 will generally not rotate clockwise (arrow 60) as the wire end 46*a* moves thereunder against the serrated edge 43. Therefore, the short axis of the cam 42 remains against the wire end 46*a* to allow it to pass under the cam. Arm 40*a* and cam 42 are rotationally mounted to clip 18*a* to rotate about an axis 63. Once the wire end 46*a* is pulled tight, as illustrated in FIG. 3A, the serrated edge of cam 42 will grip end 46*a* and prevent it from losing tension.

Referring to FIG. 3A, the tension on the wire end 46*a* will be in the direction of arrow 65, thus driving cam 42 in a counterclockwise direction as illustrated by arrow 67. However, since cam 42 will rotate in the counterclockwise direction 67, the long axis of the cam 42 is directed against the wire, and the wire end 46*a* is gripped. While the cam will generally rotate significantly in the counterclockwise direction 67, it will generally not rotate in the clockwise direction 60, although slight rotation in the clockwise direction 60 may be acceptable.

Once the wire ends 46 are captured by standoff apparatus 10, a manual tying device or other tying device 75 is directed between the ends of the standoff apparatus and between the respective legs and retention clips to engage the overlapped wire ends 46 and twist and tie the ends with a twist or knot structure 70 as illustrated in FIG. 3A. To that end, the standoff apparatus 10 includes a projection 72 extending from body 12 generally between the two legs 14*a*, 14*b*. The projection is configured to engage an opening 74 formed within a tying device 75 which is moved against the standoff. As mentioned above, the standoff is positioned against a bale of material to be tied either vertically or horizontally. Generally, the standoff apparatus 10 will be utilized with a manual tying device; however, an automatic tying device may be used as well. Once the overlapped wire ends 46 are tied together with a twist or knot 70, the wire ends may be removed from the standoff structure so that the bale may move on for further processing.

Figure 4:
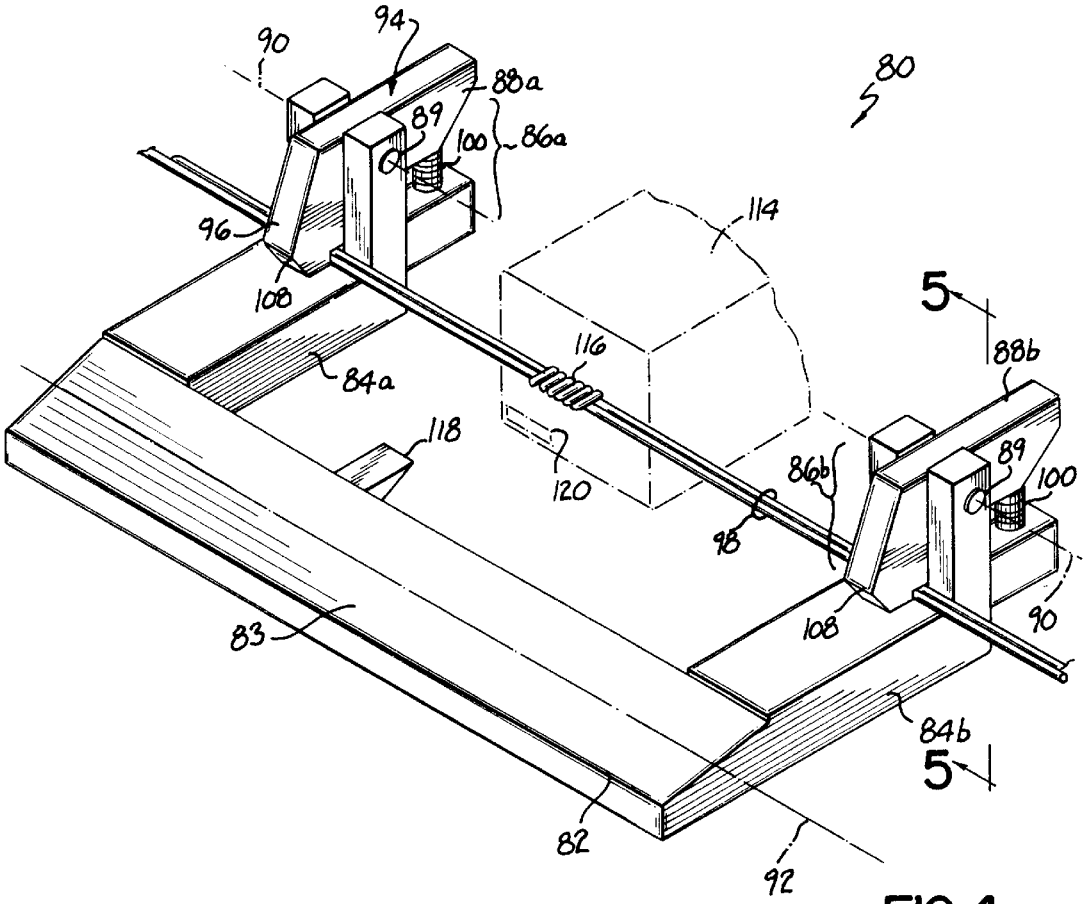
FIG. 4 is a perspective view of another embodiment of the invention.

FIG. 4 illustrates an alternative embodiment of the invention which operates in a somewhat similar fashion as the standoff apparatus previously described. Standoff apparatus 80 has a body 82 and two legs 84*a*, 84*b*. Each of the legs includes forked portions 86*a*, 86*b*. The legs 84*a*, 84*b* extend generally perpendicular to the longitudinal axis 92 of the body 82. The forked portions 86*a*, 86*b* extend generally at right angles to the legs 84*a*, 84*b*. Retention clips 88*a*, 88*b* are rotationally mounted on pins 89 which define a rotational axis 90 generally parallel to the longitudinal axis 92 of the body 82. Each of the clips includes a biased portion 94 and a capture portion 96 for capturing overlapped wire ends 98 positioned against the standoff apparatus 80. A biasing spring 100 biases each of the retention clips 88*a*, 88*b* against the overlapped wire ends 98.

Figure 5:
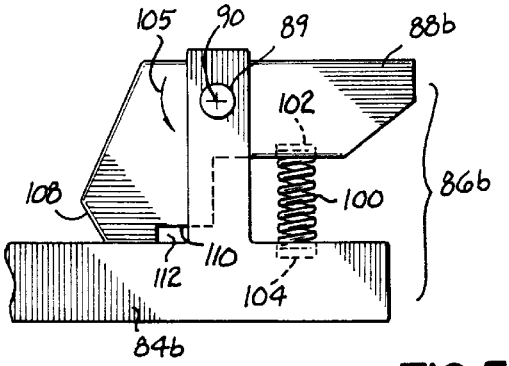
FIG. 5 is a side view of the embodiment in FIG. 4.

Referring to FIG. 5, the biasing spring 100 fits into depressions formed in each of the body 82 and retention clips 88*a*, 88*b*. Specifically, an indentation 102 is formed in the biased portion 94 of each retention clip, and a similar indentation 104 is formed in a portion of the legs 84*a*, 84*b* directly below the indentation 102 of the clips. Biasing spring 100 is compressed between the two indentations 102 and 104 and biases the clips 88*a*, 88*b* in a direction indicated by reference arrow 105. In that way, the clips 88*a*, 88*b* are spring biased to grip the overlapped wire ends 98 positioned in the standoff. The clips rotate about the axis 90 defined by pins 89.

When the overlapped wire ends 98 are positioned on the body 82 of the standoff apparatus 80 generally parallel to the longitudinal axis 92, the clips 88*a*, 88*b* grip the ends to hold them stretched and side-by-side between the ends of the standoff structure 80 as illustrated in FIG. 4. To that end, each of the clips includes a downwardly sloped front surface 108 which engages the overlapped wire ends 98 as they are directed against the clips 88*a*, 88*b*. The wire ends 98, as they are directed against the clips 88*a*, 88*b*, will engage surfaces 108 and will cause the clips to pivot upwardly automatically to allow the wire ends to slide thereunder. That is, the clips pivot under the force of the wire ends against the standoff structure. No additional steps are required. An indent 110 is formed in each clip and thereby forms openings 112 between the clips 88*a*, 88*b* and the legs 84*a*, 84*b* of the standoff apparatus. The openings 112 capture the overlapped wire ends as illustrated in FIG. 4 as the wires are moved against the clips and the clips pivot upwardly. Due to the action of the wires against the sloped surfaces 108, the bias spring 100 is compressed and seeks to drive the clip in the direction indicated by the arrow 105. Once the overlapped wire ends are positioned in the openings 112, the clips will pivot downwardly to again contact the legs 84*a*, 84*b* of the standoff apparatus 80. In that way, the overlapped wire ends 98 are captured by the standoff and held parallel to each other for tying. The surface 83 of body 82 is also sloped to assist in directing the wires against the clips.

Referring again to FIG. 4, a tying apparatus is moved between the legs 84*a*, 84*b* of the standoff apparatus 80 when the wire ends 98 are in position. Like the other embodiment disclosed herein, the standoff apparatus 80 is positioned against a bale of material. The tying apparatus, which may be a manual tyer, will then wrap or twist the overlapped wire ends to form a twist or knot 116. Similar to the embodiment illustrated in FIG. 1, standoff apparatus 80 includes a projection 118 which is configured to fit into an appropriately formed opening 120 in the tying apparatus 114. In that way, the tying apparatus 114 is aligned between the opposite ends of the standoff apparatus to twist and tie the overlapped wire ends 98 proximate the center of the overlap.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details representative apparatus and method, and illustrative examples shown and described. Accordingly, departures may be made from such details without departure from the spirit or scope of applicant's general inventive concept.

What is claimed is:

1. An apparatus for tensioning and holding baling wire to be used for tying a bale of material with twisted baling wire, the apparatus comprising:

an elongated body having a longitudinal axis and opposite ends;

a leg extending from each end of the body and including a forked portion;

a retention clip rotationally mounted about an axis proximate each of the forked portions;

the axis of rotation of each clip being oriented generally parallel to the longitudinal axis of the body;

the clips being operable to rotate in a first direction on said axes automatically when wires, oriented along the longitudinal axis of the body, are directed against the clips and further being operable to automatically rotate in a second direction to capture wires directed thereagainst for maintaining wires along the body;

the clips, when they rotate in the second direction, being configured to direct the wires against and into contact with the respective legs and to capture the wires between the clips and the respective legs.

2. The apparatus of claim 1 further comprising a spring coupled between the clips and the body and operable for biasing each of the retention clips in the second direction against the respective legs for automatically capturing wires against the legs.

3. The apparatus of claim 2 wherein said springs are stretched under tension between the retention clips and a portion of the body, the springs biasing the clips in the second direction.

4. The apparatus of claim 2 wherein said springs are compressed between the retention clips and a portion of the body, the springs biasing the clips in the second direction.

5. The apparatus of claim 2 wherein said clips have capture portions and biased portions, the axis of rotation being positioned between said capture and biased portions.

6. The apparatus of claim 5 wherein said spring acts against the biased portion of the clip.

7. The apparatus of claim 1 wherein at least one of said clips comprises a sloped surface configured to slope toward the respective leg, the sloped surface causing the clip to move in said first direction when wires oriented along the longitudinal axis are directed against the sloped surface of the clip.

8. The apparatus of claim 1 wherein at least one forked portion comprises a sloped surface configured to slope toward the respective retention clips, the sloped surface causing the clip to move in said first direction when wires oriented along the longitudinal axis are directed against the sloped surface.

9. The apparatus of claim 1 further comprising a cam rotationally mounted with respect to at least one of said clips, the cam being oriented along the longitudinal axis of said body and configured for engaging wires captured by the clip, the cam rotatable in one direction to allow a wire to pass thereby as the wire is moved along the body in that direction, and generally not rotatable in the other direction to grip the wire moved in the opposite direction.

10. The apparatus of claim 1 further comprising a projection extending from the body, the projection configured to engage, an opening in a hand tier to align the hand tier with the body.

* * * * *